United States Patent [19]

Kliebert

[11] Patent Number: 4,722,103

[45] Date of Patent: Feb. 2, 1988

[54] SPLASH GUARD

[76] Inventor: Elbert J. Kliebert, 8023 Addicks-Clodine, Houston, Tex. 77083

[21] Appl. No.: 838,252

[22] Filed: Mar. 10, 1986

[51] Int. Cl.[4] ..... E03C 1/181

[52] U.S. Cl. ..... 4/658

[58] Field of Search ..... 4/658; 68/225, 233; D32/53, 54, 67

[56] References Cited

U.S. PATENT DOCUMENTS

| | | | |
|---|---|---|---|
| 277,109 | 5/1883 | Butzbach | 68/225 |
| 562,459 | 6/1896 | Davis | 4/658 X |
| 2,635,253 | 4/1953 | Kirvay | 4/658 |
| 2,762,062 | 9/1956 | Barton | 4/658 |

*Primary Examiner*—Charles E. Phillips

*Attorney, Agent, or Firm*—Ned L. Conley; William E. Shull; Gregory L. Maag

[57] ABSTRACT

A device for preventing liquids or liquid-like substances splashed out of a bowl or basin from falling onto a background surface includes a base for supporting the device around a portion of the bowl or basin. A shield portion is attached to and extends upwardly from the base between the bowl or basin and the background surface. The base may include legs on opposite sides of a cutout in the shield portion for allowing access to a faucet or other fixture. The shield portion may be provided with an overhang folding back over the bowl or basin from the top of the shield portion, such overhang having a lip disposed vertically over the bowl or basin. The shield portion may include a rear shield and two side shields attached substantially perpendicularly to the base and to one another, and the base may include a lip for extending over an edge of the basin. The device preferably is made of a transparent or translucent material, such as acrylic plastic, safety glass, or the like.

3 Claims, 6 Drawing Figures

SPLASH GUARD

BACKGROUND OF THE INVENTION

The present invention relates generally to a device used to prevent water or other liquids or liquid-like substances from being splashed out of a basin or bowl onto background and surrounding surfaces, such as mirrors, walls, counters, or curtains. More particularly, the present invention relates to a device which not only prevents such splashing, but at least in some preferred alternative embodiments, directs splashed liquids or liquid-like substances to flow back into the bowl or basin.

Presently, while washing or cleaning articles in a sink or basin, water or a mixture of soap and water is commonly accidentally splashed out of the basin onto background surfaces such as walls, mirrors, curtains or the like. Similarly, the same liquids and liquid-like substances are frequently splashed upon the surrounding countertops or sink tops. Such splashing necessitates the constant or periodic troublesome wiping or cleaning of these surrounding and background surfaces. When the background surface is a bathroom mirror, for example, the splashed liquids, if left uncleaned, tend to spot and dirty the mirror, thereby obscuring one's view through the mirror, or at least causing an unsightly condition hinting at a lack of proper housecleaning practices, or even worse, proper hygienic conditions. Additionally water and other liquids may typically be splashed onto the sink top or counter top behind the sink and, if not cleaned or removed, will leave hard to clean residue or deposits. This is especially true when such splashing reaches a corner or crevice formed by the joint between a background surface, such as a wall, and a countertop. Because of its inaccessibility, mildew may typically develop in such a corner.

In the past, at periodic intervals such background and surrounding surfaces were cleaned with water or any one of a number of commercially available glass or plastic cleaners. If curtains served as the background behind the sink, these typically had to be removed and washed.

Common too are splashes from bowls containing food or beverages when such foods are being served as, for example, in a food service facility such as a cafeteria. Liquid or liquid-like foods which have been splashed from a bowl or serving dish and allowed to dry are exceptionally difficult to clean from crevices, counters, walls and the like. Thus, a device which would prevent water and other liquid-like substances from being splashed onto the background and surrounding surfaces is desirable. Such a device which would additionally return any splashed liquids or liquid-like substances back into the basin or bowl would be ideal.

SUMMARY OF THE INVENTION

The present invention solves the problems discussed above by providing a device to prevent surfaces from being splashed with liquids or other liquid-like substances. The device includes a base means, a shield portion, and a means for connecting the shield portion to the base means so as to support the shield portion in a position such that it can prevent such liquids or other substances from being splashed onto the background and surrounding surfaces. The shield portion and the base means may, for example, comprise a single unitized structure, whereby he shield portion and the base means are manufactured of a single piece of plastic, such as an acrylic, safety glass, or other suitable transparent or non-transparent material. The device may be designed so that any splashed liquids or substances will flow back into the bowl or basin. For example, the shield portion may comprise an overhang or shoulder so that liquid or liquid-like substances splashed onto the shield are directed to flow down the shield and back into the bowl or basin. In addition, the invention includes a shield portion comprising a rear shield and a plurality of side shields wherein the rear shield is secured to the base in a substantially perpendicular manner and the side shields, being parallel to one another, are attached to the rear shield and the base so as to be substantially perpendicular to both.

BRIEF DESCRIPTION OF THE DRAWINGS

For an introduction to the detailed description of the preferred embodiment of the invention, reference will now be made to the accompanying drawings wherein.

DESCRIPTION OF THE PREFERRED EMBODIMENT

Figure 1:
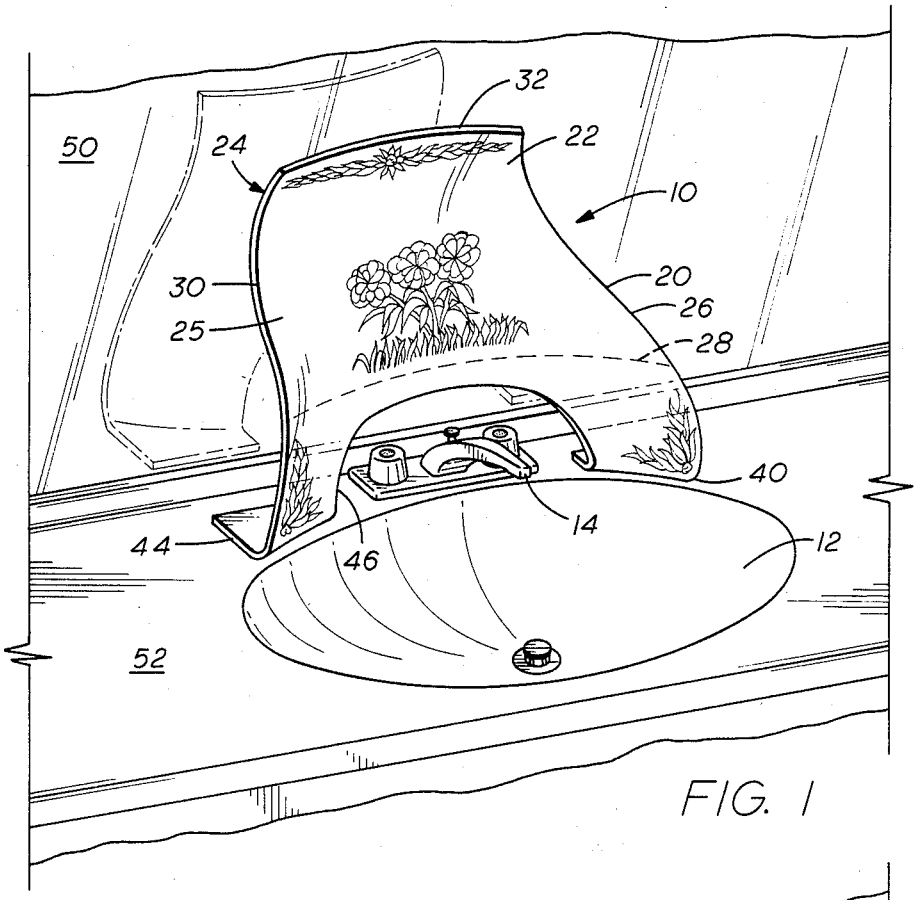
FIG. 1 depicts a perspective view of a device manufactured in accordance with the principles of the invention set forth herein.

To avoid the necessity of difficult and time consuming cleaning of the background and surrounding surfaces near a bowl or basin which contains liquids or liquid-like substances, especially where the bowl or basin includes a faucet or other means for introducing such liquids into the bowl or basin at high velocity or pressure, it is desirable to prevent the liquids or liquid-like substances from being splashed onto the background and surrounding surfaces. It is further desirable that such a device be easily cleaned, and it would be nearly ideal if the device would cause the splashed substances to flow back into the bowl or basin. Accordingly, there is shown in FIG. 1, a splash guard structured in accordance with the principles of the present invention which is used near basin 12 to partially protect mirror 50 and counter top 52 from being splashed. The splash guard 10 comprises a shield portion 20 and a base 40, unitized in a single structure and manufactured of a suitable plastic material such as an acrylic or the like. Such materials are preferably transparent so as to allow one to see through the shield portion 20 into the mirror 50, or translucent so as to allow light to be reflected from the mirror 50 into the basin 12 in order to avoid minimizing the light falling upon the basin 12. The material used for shield portion 20 should be hard, scratch resistant, and shatter proof to avoid becoming marred from normal wiping or handling during use. It may be frosted, or provided with appropriate designs or decorations suitable to the decor of the room in which it is used. As stated above, besides plastic, a safety glass or the like may be used. It should also be understood that a solid, opaque material, such as a metal, could be used if desired. The shield portion 20 comprises a front surface 22 and a rear surface 24. As shown in FIG. 1, front surface 22 is formed with a concave portion 25 and an overhang 26. This concave curvature directs any water or liquid which is splashed onto the shield portion 20 to flow down the front surface 22 and back into basin 12. As the liquid flows down front surface 22, it reaches overhang 26 where gravity causes the liquid to drop off of the splash guard 10 into the basin 12 at dripline 28.

As described above, the base 40 is preferably manufactured along with the shield portion 20 as a single unitized structure. As shown in FIG. 1, the base 40 comprises legs 44 which support the shield portion 20 in a substantially upright position. A cutout 46 is manufactured in shield portion 20 between legs 44 so as to allow the faucet or fixture 14 to extend into the basin area and to allow a person to operate the fixture without having to reach behind splash guard 10.

Figure 3:
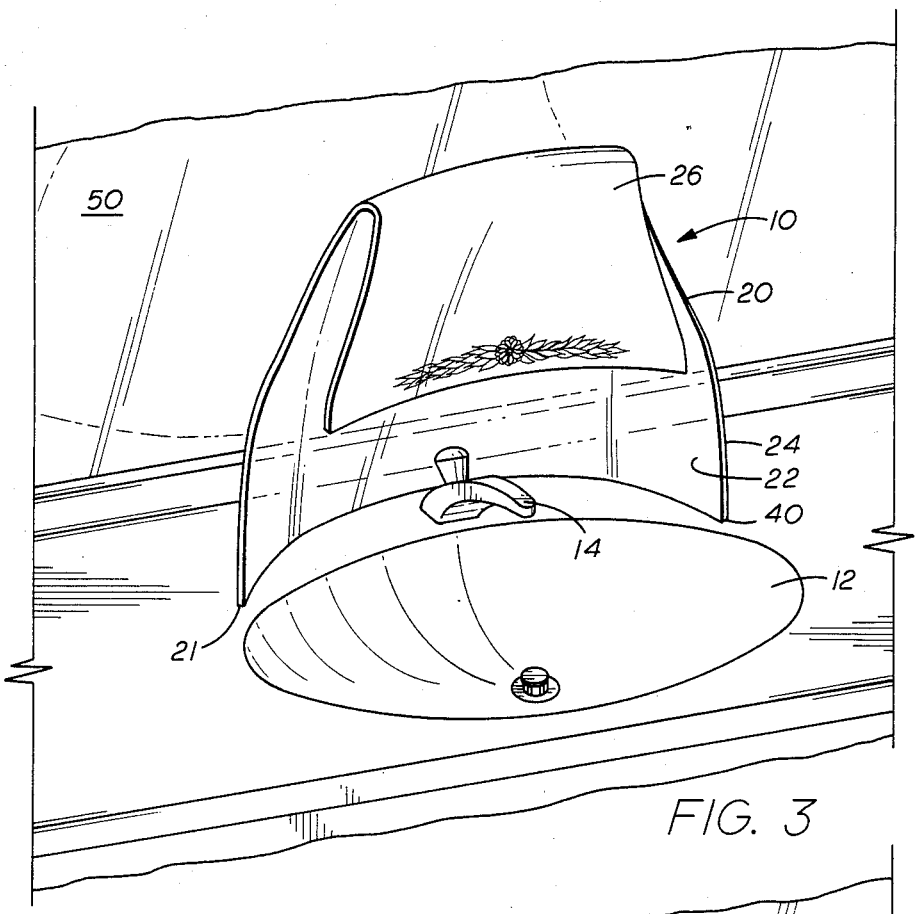
FIG. 3 depicts a perspective view of another embodiment of the invention.

Referring now to FIG. 3 there is shown another embodiment of the present invention in which the base 40 is formed by the bottom surface 21 of the shielf portion 20. The concave, arc-shaped configuration of front surface 22 and symmetrical rear surface 24 provide the stability to enable splash guard 10 to remain in a substantially upright position. As further shown in FIG. 3, this embodiment of the invention includes an overhang 26 which folds down over the top of shield portion 20 and the lip of which is disposed vertically over basin 12. Liquids which are splashed from basin 12 are not likely to contact background 50, but will instead splash onto front surface 22, or overhang 26. Liquids splashing on overhang 26 will similarly not contact background 50, but instead will be drawn by gravity back into basin 12.

Figure 2:
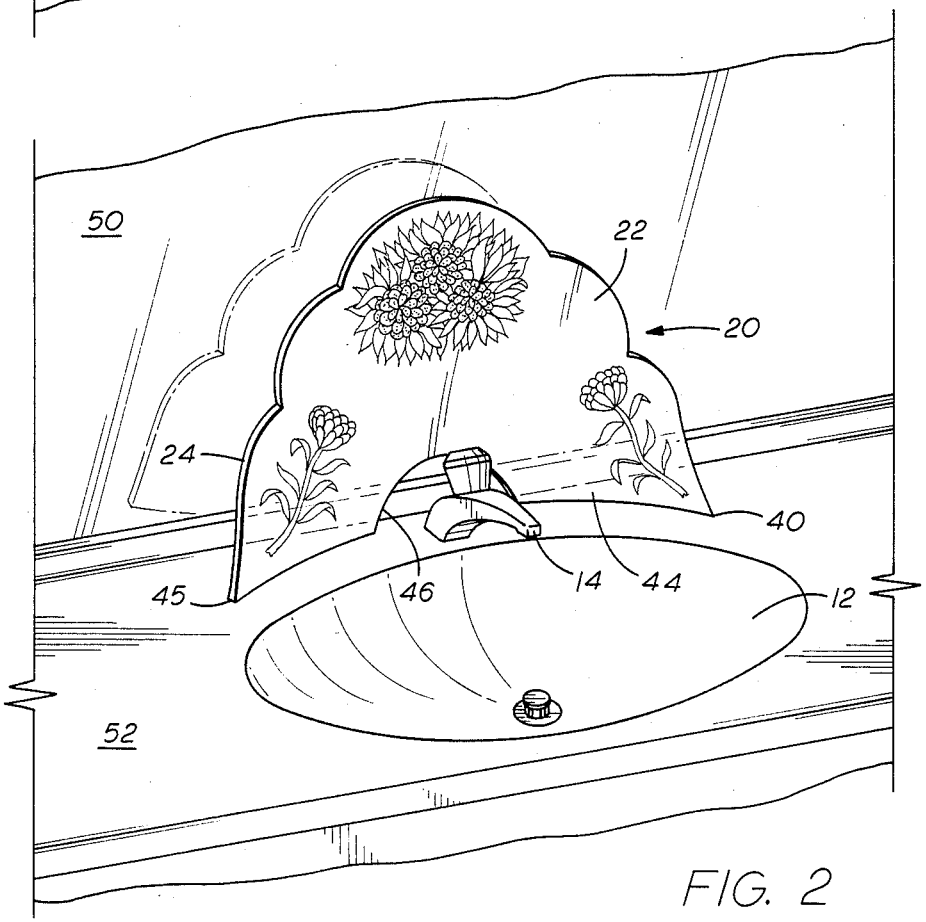
FIG. 2 depicts a perspective view of an alternate embodiment of the invention.

Referring now to FIG. 2, there is shown a splash guard in accordance with the present invention having base 40 comprising legs 44 and cutout 46. Cutout 46 allows fixture 14 to extend out over basin 12 while, at the same time, allowing access to fixture 14 and preventing liquid from splashing from basin 12 onto background mirror 50. Base 40 is formed by the bottom surfaces 45 of legs 44. The symmetrical curvature of front surface 22 and rear surface 24 of shield portion 20 stabilizes the shield portion 20 and allows it to remain in its substantially upright position.

Figure 4:
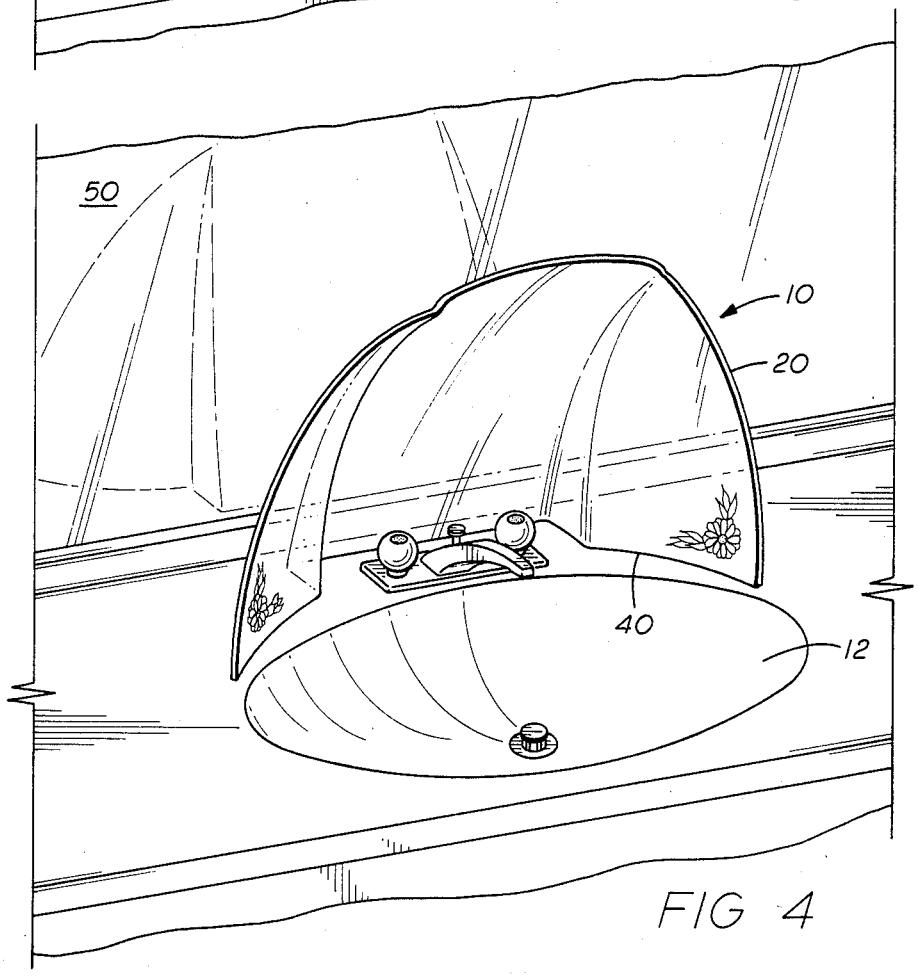
FIG. 4 depicts a perspective view of still another embodiment of the invention.
Figure 5:
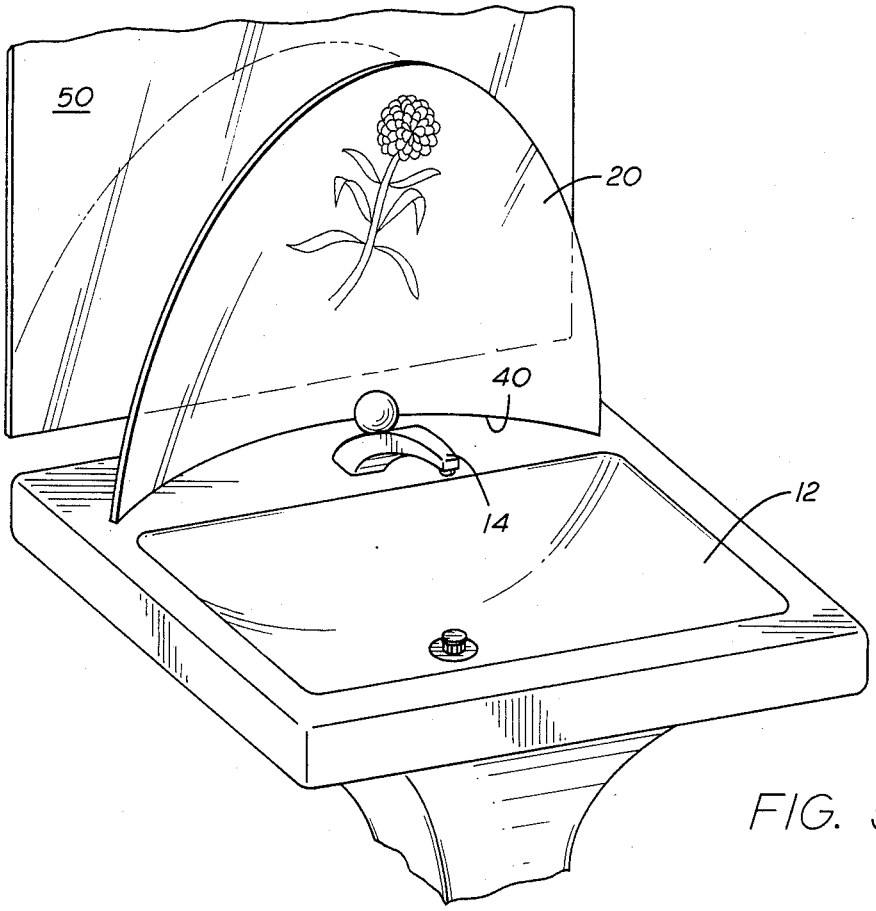
FIG. 5 depicts a perspective view of a further embodiment of the present invention.

Referring to FIGS. 3, 4, and 5, it can be seen that embodiments of the present invention can be designed by one skilled in the art so that fixture 14 is easily accessible without the necessity of manufacturing a cutout portion, for example as at 46 in FIGS. 1 and 2, in shield portion 20.

Figure 6:
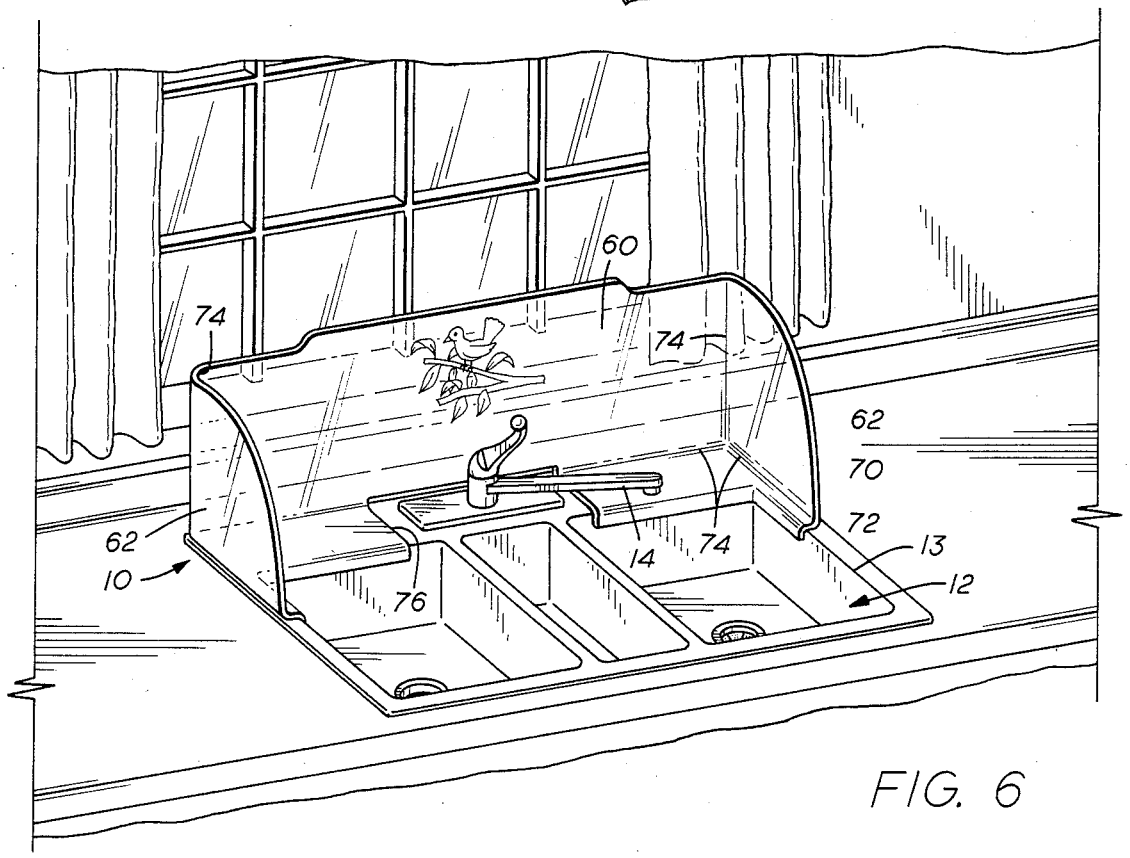
FIG. 6 depicts a perspective view of another embodiment of the present invention.

Referring now to FIG. 6, there is shown a splash guard 10 in accordance with the present invention designed for use with a rectangularly shaped sink. As generally depicted, splash guard 10 comprises a rear shield 60, side shields 62, and base 70. As shown, both rear shield 60 and side shields 62 are connected to base 70 in a substantially perpendicular and upright manner, such side shields also being connected substantially perpendicularly to the rear shield and parallel to each other. Formed in base 70 is a lip 72, adapted to overhand and engage edges 13 of basin 12. Cutout 76 is provided in base 70 to allow access to fixture 14 and to allow fixture 14 to extend through splash guard 10. As depicted in Fixture 6, rear shield 60, side shields 62, and base 70 meet and form generally rounded corners 74 so as to provide ease of cleaning.

It can be seen that the present invention provides a device which prevents liquids from splashing from a bowl or basin onto background and surrounding surfaces and a device which directs such splashed liquids back into the basin, such a device being easily and quickly cleaned. While a preferred embodiment of the invention has been shown and described, modifications or equivalents thereof can be made by one skilled in the art without departing from the spirit of the invention.

I claim:

1. A freestanding and portable device for use on a horizontal sink top installation for preventing liquids or liquid-like substances splashed out of a sink bowl or basin from falling onto background surfaces behind said bowl or basin and which device extends vertically above the uppermost portion of the sink top installation, wherein such bowl or basin includes a faucet or similar fixture mounted on said installation adjacent said bowl or basin comprising:

a freestanding base for supporting the device around a portion of such bowl or basin, said freestanding base being free of attachment to any of such bowl, basin, sink top installation or background surfaces;

a shield portion extending upwardly from such base between the bowl or basin and the background surfaces and extending above the uppermost portion of the sink top installation, said shield portion comprising a front side having at least one concave surface and a dripline portion at the bottom of such concave surface from which such liquids or liquid-like substances drip and fall back into such bowl or basin; and means for attaching said shield portion solely to said base to form a single unitized structure, such that said shield portion and said base form a freestanding and portable device, and said base includes a pair of legs disposed on opposite sides of a cutout in said upwardly extending shield portion, said cutout spanning said faucet or fixture and extending upwardly from the point of attachement of said base and said shield portion and terminating below said dripline portion for permitting access through said shield portion to such faucet or fixture of such bowl or basin from such front side of said shield portion even when such faucet or fixture is disposed substantially behind said shield portion.

2. A device according to claim 1, wherein said shield portion is made of a translucent material.

3. A device according to claim 1, wherein said shield portion is made of a transparent material.

* * * * *